US005545867A

United States Patent [19]

Castonguay et al.

[11] Patent Number: 5,545,867

[45] Date of Patent: Aug. 13, 1996

[54] MOTOR OPERATOR INTERFACE UNIT FOR HIGH AMPERE-RATED CIRCUIT BREAKERS

[75] Inventors: Roger N. Castonguay, Terryville; James L. Rosen, West Hartford; Mark A. Zaffetti, Windsor Locks, all of Conn.

[73] Assignee: General Electric Company, New York, N.Y.

[21] Appl. No.: 220,382

[22] Filed: Mar. 30, 1994

[51] Int. Cl.[6] ..... H01H 5/00

[52] U.S. Cl. ..... 200/400; 74/2; 185/40 R

[58] Field of Search ..... 200/400, 401, 200/402, 337, 323, 318; 74/2, 3, 3.5, 4; 185/40 R, 41 R

[56] References Cited

U.S. PATENT DOCUMENTS

| | | | |
|---|---|---|---|
| 2,581,181 | 1/1952 | Favre . | |
| 3,689,720 | 9/1972 | Patel | 200/400 |
| 4,001,742 | 1/1977 | Jencks et al. . | |
| 4,245,140 | 1/1981 | Jencks et al. | 200/400 |
| 4,649,244 | 3/1987 | Baginski et al. . | |
| 4,801,907 | 1/1989 | Kelaita, Jr. et al. . | |

OTHER PUBLICATIONS

U.S. Ser. No: 08/202,140 filed Feb. 25, 1994 entitled: "Operating Mechanism For High Ampere–Rated Circuit Breakers"—Castonguay et al (41PR–7116).

U.S. Ser. No: 08/203062 entitled: Rating Module Unit For High Ampere–Rated Circuit Breakers filed Feb. 28, 1994 (Castonguay et al) (41PR–7124).

U.S. Ser. No: 08/214522 entitled: Handle Operator Assembly For High Ampere–Rated Circuit Breaker filed Mar. 18, 1994 (Castonguay et al) (41PR–7130).

*Primary Examiner*—Henry J. Recla
*Assistant Examiner*—David J. Walczak
*Attorney, Agent, or Firm*—Richard A. Menelly

[57] ABSTRACT

This invention relates to a high ampere-rated circuit breaker which meets the electrical code requirements of the world market. The charging of the powerful operating springs controlling the circuit breaker contacts is made automatically by means of an electric motor. The circuit breaker operating handle connects with the operating springs through a motor operator interface unit to allow manual charging of the operating springs upon stalling of the electric motor.

13 Claims, 6 Drawing Sheets

MOTOR OPERATOR INTERFACE UNIT FOR HIGH AMPERE-RATED CIRCUIT BREAKERS

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. patent application Ser. No. 08/202,140 filed Feb. 25, 1994 entitled "Operating Mechanism for High Ampere-Rated Circuit breaker" describes an operating mechanism capable of immediately resetting the circuit breaker operating mechanism to reclose the contacts without having to recharge the circuit breaker operating springs immediately after opening the circuit breaker contacts.

U.S. patent application Ser. No. 08/203,062 filed Feb. 28, 1994 entitled "Rating Module for High Ampere-Rated Circuit Breaker" describes a circuit breaker closing spring modular unit whereby the circuit breaker operating springs are contained within a separate unit from the operating mechanism and can be installed within the circuit breaker enclosure without disturbing the operating mechanism assembly.

U.S. patent application Ser. No. 08/214,522 filed Mar. 18, 1994 entitled "Handle Operator Assembly for High Ampere-Rated Circuit Breaker" describes a handle operator unit capable of generating large spring charging forces by means of an externally-accessible manually operated handle. A ratchet and pawl assembly allows the manually-applied charging forces to be applied to the operating springs. Once the circuit breaker operating mechanism closing springs are fully-charged, some means must be employed to release the pawl to allow the closing springs to become fully operational U.S. Pat. No. 4,649,244 describes the use of an electric motor to automatically charge the circuit breaker closing springs. The motor connects with the closing spring shaft through a planetary gear assembly and a complex cam arrangement.

The present invention describes a simplified arrangement for interfacing between the electric motor and the circuit breaker closing springs charging assembly with less components and at a lower cost.

SUMMARY OF THE INVENTION

The circuit breaker operating mechanism closing springs are charged both automatically by means of an electric motor as well as manually by means of an externally accessible operating handle. A friction clutch arrangement allows the circuit breaker closing springs to be manually charged by operation of the operating handle.

DESCRIPTION OF THE PREFERRED EMBODIMENT

Figure 1:
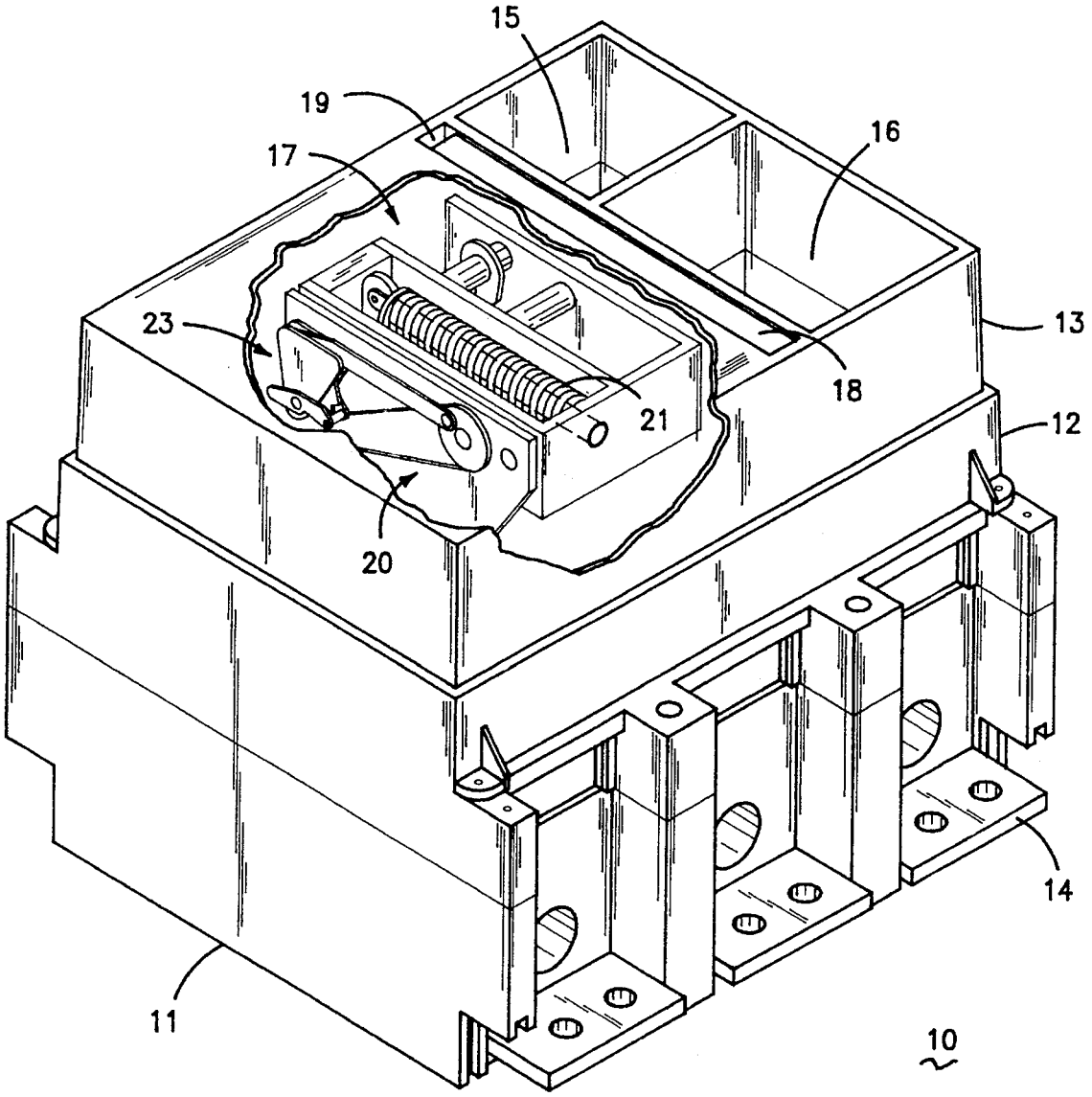
FIG. 1 is a top perspective view of a high ampere-rated circuit breaker with a portion of the circuit breaker cover removed to depict the operating springs motor operator interface unit according to the invention.

The high ampere-rated circuit breaker 10 shown in FIG. 1 is capable of transferring several thousand amperes quiescent circuit current at several hundred volts potential without overheating. The Circuit breaker consists of an electrically insulated base 11 to which an intermediate cover 12 of similar insulative material is attached prior to attaching the top cover 13, also consisting of an electrically-insulative material. Electrical connection with the interior current-carrying components is made by load terminal straps 14 extending from one side of the base and line terminal straps (not shown) extending from the opposite side thereof. The interior components are controlled by an electronic trip unit contained within a recess 16 on the top surface of the top cover 13. Although not shown herein, the trip unit is similar to that described within U.S. Pat. No. 2,581,181 and interacts further with an accessory contained within the accessory recess 15 to provide a range of protection and control functions such as described, for example within U.S. Pat. No. 4,801,907. The operating mechanism 17 as described within the aforementioned U.S. patent application Ser. No. 8/203,062 includes the means required to charge the powerful closing springs 21 through a motor operator interface unit 20 which includes a clutch assembly 23. Manual forces to charge the closing springs are provided through operation of the operating handle 18 arranged within the handle recess 19.

Figure 2:
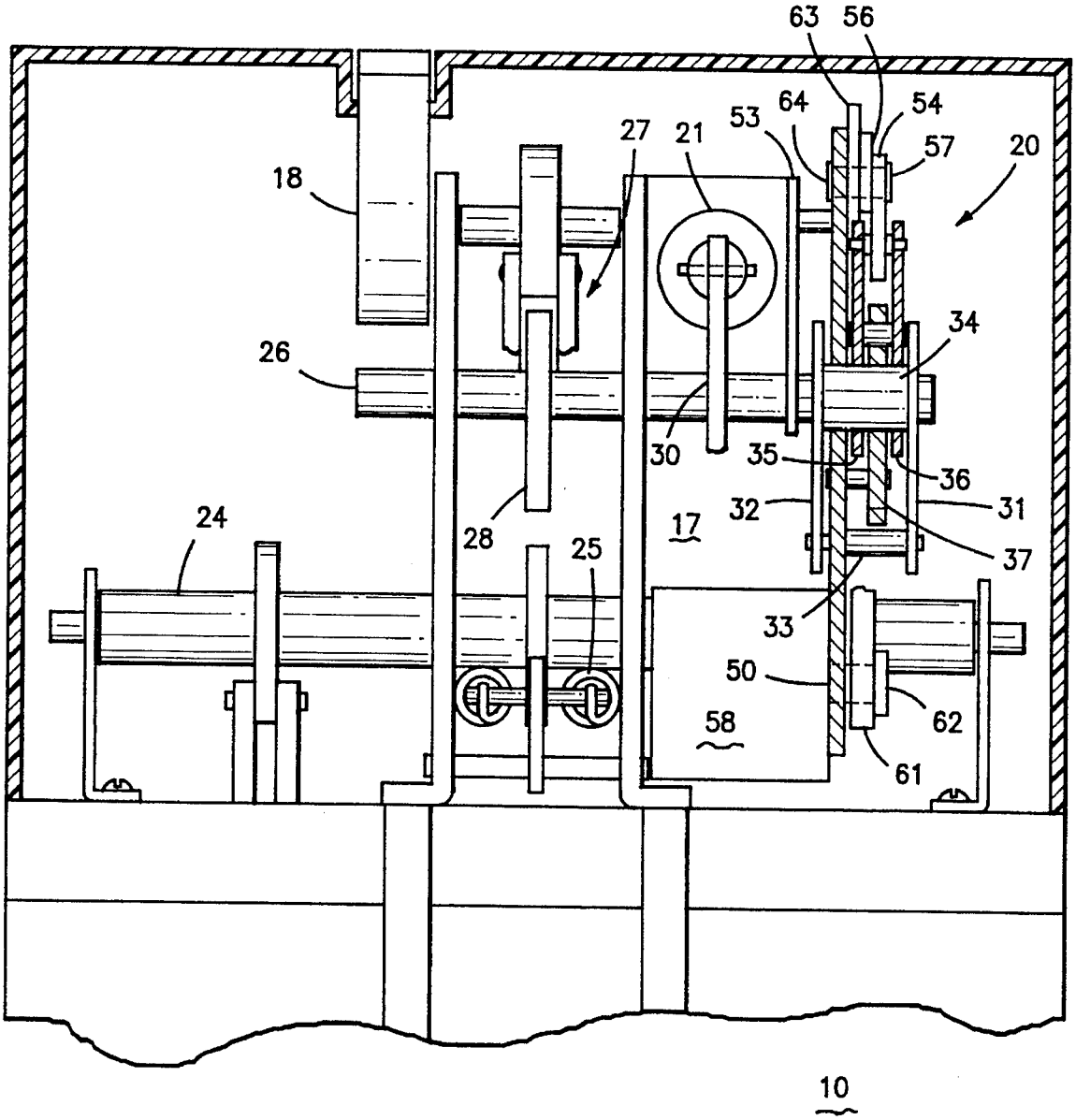
FIG. 2 is an end view in partial section of the motor operator interface unit of FIG. 1.
Figure 3:
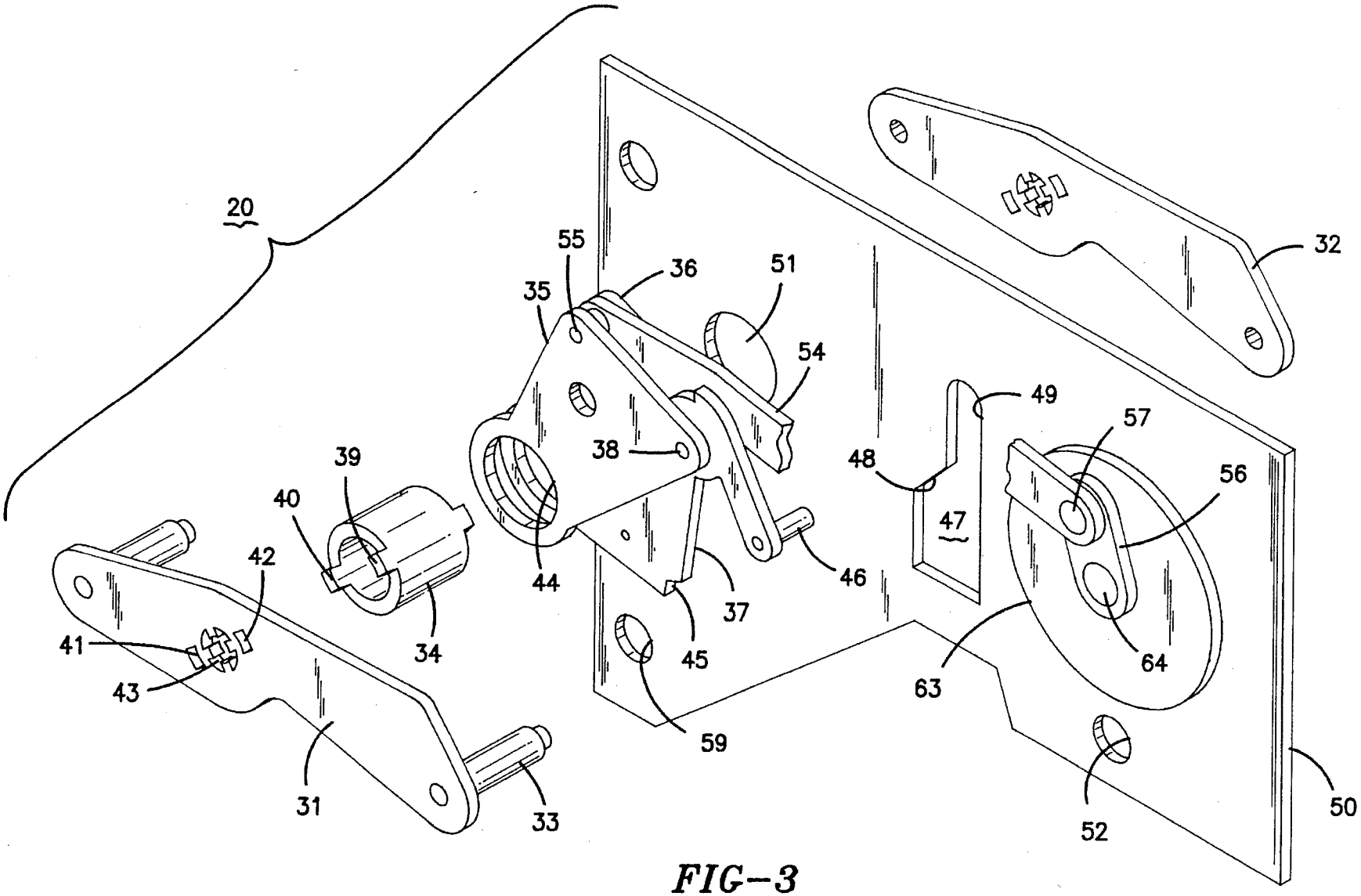
FIG. 3 is an enlarged top perspective view of the motor operator interface unit of FIG. 1 with the components in isometric projection.
Figure 4:
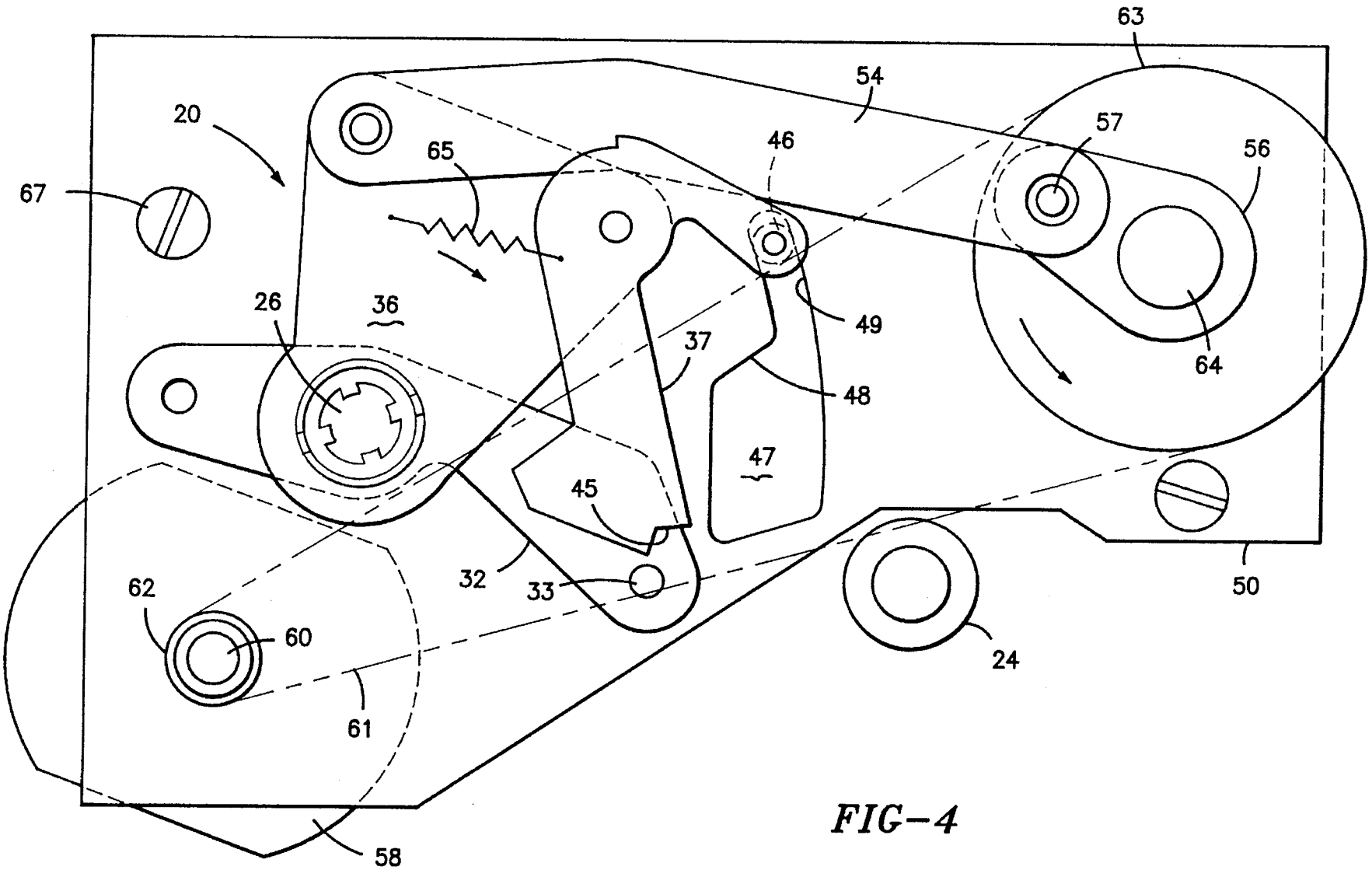
FIG. 4 is an enlarged side view of the motor operator interface unit of FIG. 1 at the start of the charging cycle.

The circuit breaker 10 is shown in FIG. 2 to depict the location of the handle 18 relative to the handle closing shaft 26 within the operating mechanism 17. The drive shaft 24 which operates to open the circuit breaker contacts is biased by means of a separate pair of operating springs 25 as described within the aforementioned U.S. Pat. No. 4,001,742. The closing shaft 26 which connects with the closing springs 21 by means of the closing crank 30 also connects with the motor operator interface unit 20 by means of a pivot sleeve 34. The automatic operation of the motor operator interface under the operation of the electric motor 58 as well as by manual operation of the operating handle 18 to charge the closing springs 21 is best seen by referring to both FIGS. 2 and 3 at the same time. The operator interface unit 20 consists of a pair of closing shaft links 31, 32 which attach the unit to the closing shaft by means of the shaped apertures 43. The pivot sleeve 34 is accurately positioned within the unit by capture of the positioning tabs 39, 40 extending from opposite ends of the sleeve within corresponding slots 41, 42 formed within the closing shaft links. A pair of motor drive plates 35, 36 are positioned over the pivot sleeve 34 by insertion of the sleeve within the clearance openings 44 formed within one end of each of the motor drive plates and the clearance opening 51 formed within the motor operator interface unit support plate 50. In accordance with the teachings of the invention, a friction clutch 37 is sandwiched between the motor drive plates and interacts with the clutch drive pin 33 extending between the drive plates by means of the triangular slot 45 in the manner to be described below. The elongated drive link 54 which is attached to the drive plates by means of the drive link pivot 55 interacts with bell crank 56 by means of the drive link post 57 extending from the end of the drive link. The drive link 54 is broken to depict the positioning track 47 formed within the mounting plate 50 which track receives the clutch positioning pin 46 extending from one end of the friction clutch 37. The positioning pin is driven within the positioning track in cam-follower relation along the ramped edge 48 and the narrow end 49 thereof. The bell crank 56 is attached to a pulley 63 for rotation about the bell crank and pulley pivot 64. The assembled motor operator unit is completely contained and supported on the mounting plate 50 which is attached to the closing spring sideframe 53 by means of a pair of thru-holes 52 and associated screws 67 (FIG. 4). When assembled thereto, the motor drive shaft 60 (FIG. 4) extends through the opening 59 formed in the mounting plate 50 and a pulley 62 attached to the motor shaft operatively interacts with the motor operator interface unit 20 by means of the drive belt 61 and the motor operator interface unit pulley 63.

The operation of the motor operator interface unit 20 is shown in FIG. 4 with the motor drive pulley 62 on the motor shaft 60 on the electric motor 58 connected with the pulley 63 attached to the bell crank 56 on the bell crank pivot and pulley pivot 64 by means of the drive belt 61. The mounting plate 50 is attached to the closing spring sideframe by means of screws 67 above the drive shaft 24. Although the connection between the pulleys 62, 63 by means of the drive belt 61 is simple and economically advantageous, other more costly means of connection such as planetary gears can also be employed. One of the motor drive plates 35, and one of the closing shaft links 31, is removed to depict the location of the other motor drive plate 36 on the closing shaft 26 and the location Of the clutch drive pin 33 at the end of the other closing shaft link 32 relative to the V-shaped slot 45 at one end of the friction clutch 37. It is noted that the clutch release spring 65 biases the friction clutch slot 45, at the one end the friction clutch 37, away from the clutch drive pin 33, and the clutch position pin 46, at the other end of the friction clutch 37, within the narrow dwell region 49 of the positioning track slot 47 formed in the mounting plate 50 at the start of the closing spring charging cycle. The drive link 54 that connects between the motor drive plates and the bell crank 56 on the pulley 63 by means of the drive link post 57 effectively controls the transfer of charging force from the motor drive shaft 60 to the closing shaft 26 via the bell crank pivot 64 in the manner to be described below.

Figure 5:
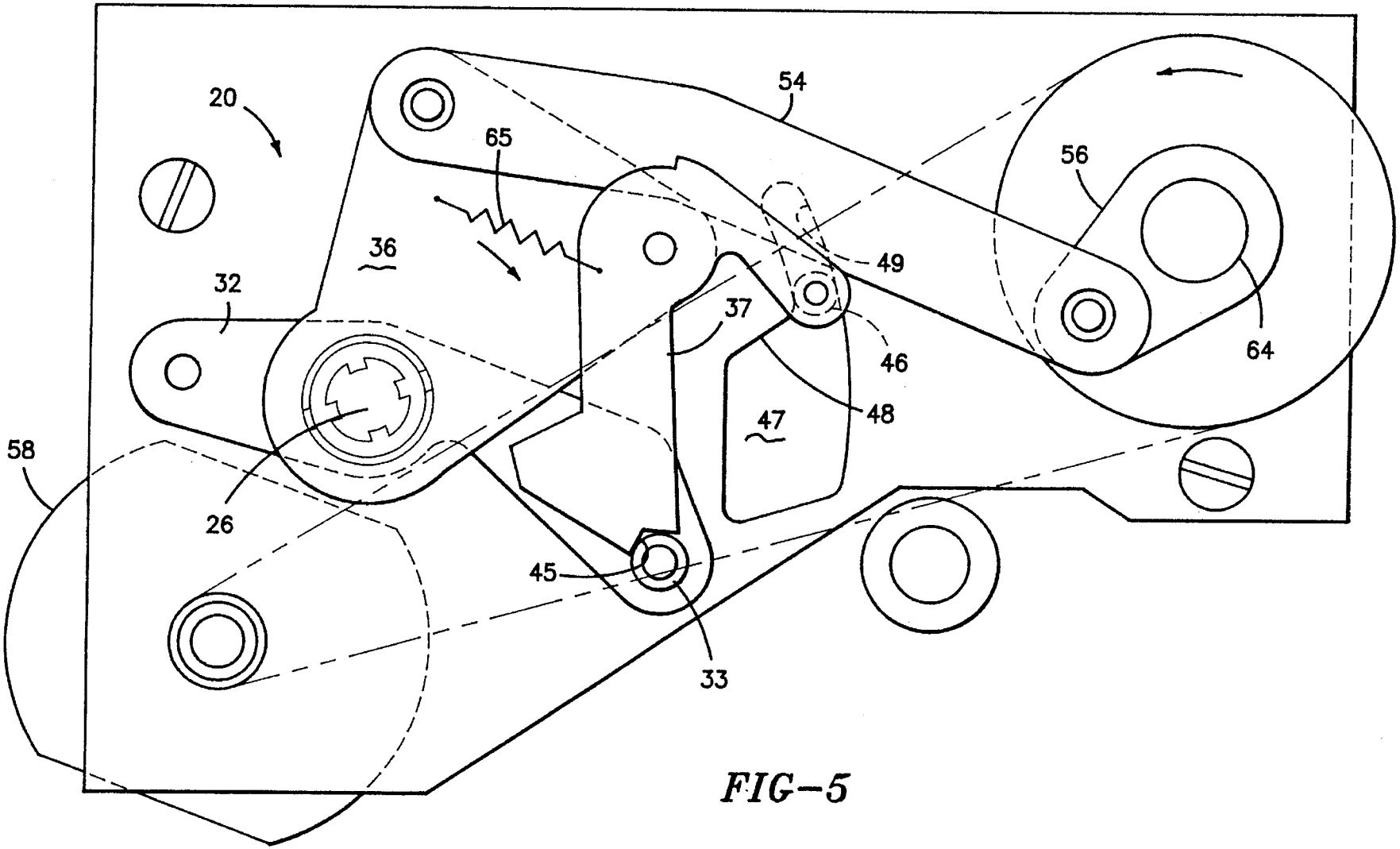
FIG. 5 is an enlarged side view of the motor operator interface unit of FIG. 1 during the charging cycle.
Figure 6:
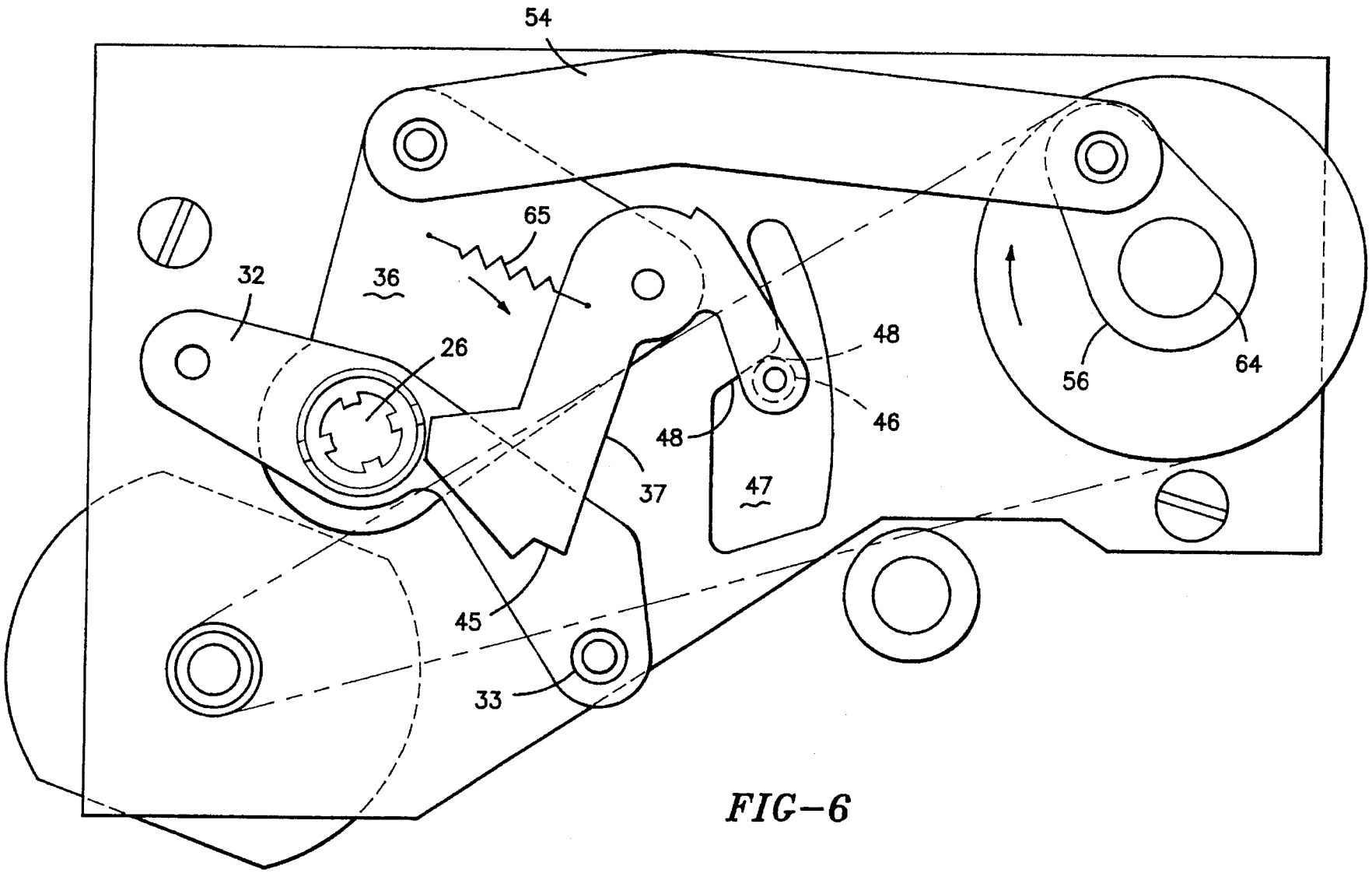
FIG. 6 is an enlarged side view of the motor operator interface unit of FIG. 1 at the close of the charging cycle.

With the electric motor 58 operational, the bell crank 56 is rotated counter-clockwise about the bell crank and pulley pivot 64 moving the drive link 54, motor drive plate 36 and the friction clutch 37 in the clockwise direction and forcing the friction clutch slot 45 against the clutch drive pin 33 against the bias of the clutch release spring 65. The clutch position pin 46 remains within the narrow dwell region of the positioning track slot 47. The friction generated between the friction clutch slot 45 and the clutch drive pin 33 holds the motor operator interface unit in the condition depicted in FIG. 5 allowing the motor 58 to deliver charging force to the closing shaft 26 and from there to the closing springs, as described earlier.

Should the motor stall during the charging cycle, the friction generated between the friction clutch slot 45 and the clutch drive pin 33 ceases as soon as manual force is applied to the handle thereby allowing the friction clutch 37 to rotate in the clockwise direction away from the clutch drive pin under the urgence of the clutch release spring 65. When operating-power is supplied by the handle, the drive link 54 rotates the bell crank 56 clockwise about the bell crank and pulley pivot 64 and the clutch positioning pin 46 is against the positioning ramp 48 within the positioning track slot 47. Upon completion of the charging of the closing springs, the motor operator interface unit 20 returns to the starting configuration shown earlier in FIG. 4.

We claim:

1. An industrial-rated circuit breaker for high level overcurrent protection comprising:

an insulative base (11):

an insulative cover (13) above said base, said cover enclosing a closing shaft (26) and a drive-shaft (24):

a closing spring (21) connecting with said closing shaft, said closing spring receiving forces for moving said spring into a charged condition:

a motor operator interface unit interfacing between said closing shaft and an electric motor (58) automatically providing said forces while said motor is operational: and a handle (18) connecting with said closing shaft allowing an operator to manually provide said forces when said motor becomes inoperative;:

a motor drive plate (35) connecting with said closing shaft: and a friction clutch (37) connecting with said drive plate, said friction clutch assuming a first position when said motor is operational to allow said motor to provide said forces, and said friction clutch assuming a second position when said motor is inoperative to allow said handle to provide said forces.

2. The industrial-rated circuit breaker of claim 1 including a closing shaft link (32) connecting with said closing shaft and including a clutch drive pin (33) at one end, said clutch drive pin contacting one end (45) of said friction clutch when said motor is operational and said clutch drive pin being away from said friction clutch when said motor is inoperative.

3. The industrial-rated circuit breaker of claim 2 including a mounting plate (50) supporting said friction clutch and a positioning track slot (47) arranged for capturing a clutch positioning pin (46) extending from an opposite end of said friction clutch.

4. The industrial-rated circuit breaker of claim 3 including a bell crank (56) pivotally attached to said mounting plate and a drive link (54) connecting between said bell crank and said motor drive plate, whereby said bell crank assumes a first position when said one end of said friction clutch is in contact with said clutch drive pin and said bell crank assumes a second position when said one end of said friction clutch is away from said clutch drive pin.

5. The industrial-rated circuit breaker of claim 4 including a motor drive shaft (60) extending from said motor and a drive pulley (62) arranged on said drive shaft.

6. The industrial-rated circuit breaker of claim 5 including a driven pulley (63) attached to said bell crank and means (61) interconnecting between said drive pulley and said driven pulley transferring forces generated by said motor to said bell crank.

7. The industrial-rated circuit breaker of claim 6 wherein said means comprises a drive belt.

8. The industrial-rated circuit breaker of claim 3 wherein said positioning track slot defines a narrow dwell region (49)

and a positioning ramp (48) adjacent said narrow dwell region.

9. The industrial-rated circuit breaker of claim 2 including a clutch release spring (65) on said motor drive plate, said release spring biasing said one end of said friction clutch away from said clutch drive pin.

10. The industrial-rated circuit breaker of claim 2 including a clearance hole (51) within said motor drive plate and a pivot sleeve (34) arranged therein, said pivot sleeve including a positioning tab (40), said positioning tab being received within a positioning slot (41) formed within said closing shaft link.

11. A motor operator interface unit comprising in combination:

a mounting plate (50):

a bell crank pivotally-attached to said mounting plate:

a motor drive plate (35) connecting with said bell crank through a drive link (54) and arranged for providing charging forces to an operator closing spring;

a friction clutch (37) connecting with said motor drive plate by means of a friction clutch pivot (38), said friction clutch including a groove (45) at one end interacting with a clutch drive pin (33) extending from one end of a closing shaft link (31), and said friction clutch including a clutch positioning pin (46) extending from an opposite end, said positioning pin being captured within a positioning track slot formed within said mounting plate (50); and a clutch release spring (65) on said motor drive plate, said release spring biasing said friction clutch end away from said clutch drive pin.

12. The operator interface unit of claim 11 wherein said positioning track slot defines a narrow dwell region (49) and a positioning ramp (49) adjacent said narrow dwell region, said clutch positioning pin being within said dwell region when an associated electric motor (58) is operational to provide said charging forces.

13. The operator interface unit of claim 11 including a pivot sleeve (34) extending through said motor drive plate for attaching said motor drive plate to a circuit breaker closing shaft (26), said sleeve including a positioning tab (40) extending from one end, said tab being received within a corresponding slot (41) in said mounting plate for accurately positioning said motor drive plate on said mounting plate.

* * * * *